United States Patent [19]

Matsumoto et al.

[11] Patent Number: 4,788,574

[45] Date of Patent: Nov. 29, 1988

[54] MULTI-COLOR IMAGE FORMING APPARATUS IN WHICH A PLURALITY OF TONER IMAGES ARE SUCCESSIVELY TRANSFERRED ONTO A PRINTING MEDIUM FROM A PLURALITY OF IMAGE CARRIERS ONE ABOVE ANOTHER

[75] Inventors: Kenichi Matsumoto, Tokyo; Kadowaki; Akihito Hosaka, both of Yokohama; Shinnosuke Taniishi, Tokyo, all of Japan

[73] Assignee: Canon Kabushiki Kaisha, Tokyo, Japan

[21] Appl. No.: 901,820

[22] Filed: Aug. 29, 1986

[30] Foreign Application Priority Data

Sep. 3, 1985 [JP] Japan ..... 60-195079

[51] Int. Cl.[4] ..... G03G 15/01

[52] U.S. Cl. ..... 355/4; 355/3 R

[58] Field of Search ..... 271/198, 264; 474/87; 198/836, 790, 604; 403/362, 356; 355/4, 14 R, 3 R

[56] References Cited

U.S. PATENT DOCUMENTS

| | | | |
|---|---|---|---|
| 1,442,037 | 1/1923 | Bamford | 474/87 |
| 2,966,746 | 1/1961 | Mellbin | 474/87 |
| 2,986,466 | 5/1961 | Kaprelian | 355/4 |
| 3,010,333 | 11/1961 | Rampe | 403/362 |
| 4,064,987 | 12/1977 | Rowan | 198/604 |
| 4,177,685 | 12/1979 | Delancy | 403/362 |
| 4,576,505 | 3/1986 | Wrightson et al. | 403/362 |

FOREIGN PATENT DOCUMENTS

| | | | |
|---|---|---|---|
| 144653 | 3/1977 | Japan | 355/4 |
| 1328065 | 8/1973 | United Kingdom | 355/4 |

*Primary Examiner*—A. C. Prescott

*Attorney, Agent, or Firm*—Fitzpatrick, Cella, Harper & Scinto

[57] ABSTRACT

An image forming apparatus is of the type in which a plurality of toner images are successively transferred onto a printing medium from a plurality of image carriers one above another. A toner image built on each of the image carriers is transferred onto the printing medium at a predetermined image transferring position. The apparatus is so constructed that each of the image carriers and printing medium conveying means are driven by single driving power transmitting means which is caused to move endlessly.

18 Claims, 6 Drawing Sheets

MULTI-COLOR IMAGE FORMING APPARATUS IN WHICH A PLURALITY OF TONER IMAGES ARE SUCCESSIVELY TRANSFERRED ONTO A PRINTING MEDIUM FROM A PLURALITY OF IMAGE CARRIERS ONE ABOVE ANOTHER

BACKGROUND OF THE INVENTION

1. Field of the Invention

The present invention relates to a multi-color image forming apparatus of the type in which a required multi-color image is obtained by transferring a plurality of color toner images having different color toner developed thereon onto a printing medium one above another. More particularly, it relates to a multi-color image forming apparatus in which a plurality of image carriers in the form of photosensitive drums or the like are disposed in parellel with one another in spaced relation and each of color toner images is successively transferred onto the printing medium after completion of latent image building and developing on each of the image carriers. The apparatus of the invention is advantageously applicable to a recording device, copying machine, printer or the like.

2. Related background art

As is hitherto known, a variety of electrophotographic multi-color image copying apparatuses have been developed and some of them are put into practical use on a commercial basis. An apparatus as shown in FIG. 6 is one of conventional copying apparatus of the above-mentioned type. As is apparent from the drawing, the apparatus includes first to fourth image forming sections Pa, Pb, Pc and Pd which are provided with photosensitive drums 1*a*, 1*b*, 1*c* and 1*d*. Latent image forming means 2*a*, 2*b*, 2*c* and 2*d*, developing means 3*a*, 3*b*, 3*c* and 3*d*, transferring means 4*a*, 4*b*, 4*c* and 4*d* and cleaning means 5*a*, 5*b*, 5*c* and 5*d* each of which are well known for any expert in the art are arranged around the photosensitive drums 1*a*, 1*b*, 1*c* and 1*d*. First, a latent image having yellow component color derived from an original image is built on the photosensitive drum 1*a* with the aid of the latent image forming means 2*a* in the first image forming section Pa by way of the steps of electrical charging and exposing and the thus formed latent image is then developed with yellow toner under the effect of the developing means 3*a*. Finally, the yellow toner image is transferred onto a printing medium 6 with the aid of the image transferring means 4*a*.

While the yellow toner image is transferred onto the printing medium 6, a latent image having magneta component color is built in the second image forming section Pb and the thus formed latent image is developed with magenta toner under the effect of the developing means 3*b*. When the printing medium 6 which has completed transference in the first image forming section Pa is then conveyed to the image transferring means 4*b* in the second image forming section Pb, a magenta toner image is transferred onto the printing medium 6 at a predetermined position where the latter has carried a yellow toner image thereon. Thereafter, image transference is carried out in the same manner as mentioned above for both cyan color and black color and after completion of image transference fixing is effected with the aid of fixing means 7 whereby a multi-color image is obtained on the printing medium 6. On completion of image transference in that way each of the photosensitive drums 1*a*, 1*b*, 1*c* and 1*d* is entirely free from residual toner with the use of the cleaning means 5*a*, 5*b*, 5*c* and 5*d*. Now, the next image building is ready to be initiated.

However, it is found with respect to the conventional apparatus as mentioned above that a problem of image deviation occurs unavoidably due to the fact that multiple image transference is achieved while the printing medium 6 is conveyed by means of a conveyor belt 8. An extent of image deviation varies widely in dependence on accuracy in movement of the conveyor belt and rotation of the photosensitive drums. To obviate the above-mentioned problem there have been already made such proposals that a driving roller having high concentricity is used to drive the conveyor belt and a train of driving gears having high dimensional accuracy is employed for the driving system.

SUMMARY OF THE INVENTION

Hence, the present invention has been made with the foregoing background in mind and its object resides in providing an apparatus of the above-mentioned type which is provided with a driving system for a plurality of image carriers such as photosensitive drums as well as for an endless conveyor belt usable for printing medium.

Other object of the present invention is to provide an apparatus of the above-mentioned type which makes it possible to successively transfer a plurality of toner images at the correct position on the printing medium while the latter is conveyed.

To accomplish the above objects there is proposed according to one aspect of the invention a color image forming apparatus of the type in which a required multi-color image is formed by successively transfering a plurality of different color toner images onto a printing medium one above another, essentially comprising a plurality of image carriers rotatably supported and including driving power receiving portions, toner image forming means located opposite to each of the image carriers to form a color toner image on the latter, image transferring means disposed at the image transferring position where a toner image built on each of the image carrier is transferred onto the printing medium, printing medium conveying means adapted to endlessly move under the effect of driving power to successively convey the printing medium to the image transferring position on each of the image carriers, endless driving power transmitting means for concurrently transmitting driving power to both the image carriers and the printing medium conveying means, and driving power source for driving the driving power transmitting means.

Further, there is proposed according to another aspect of the invention a color image forming apparatus of the type in which a plurality of different color toner images onto a printing medium one above another, essentially comprising a plurality of image carriers rotatably supported and including driving power receiving portions, toner image forming means located opposite to each of the image carriers to form a color image on the latter, image transferring means disposed at the image transferring position where a toner image formed on each of the image carriers is transferred onto the printing medium, printing medium conveying means adapted to endlessly move under the effect of driving power to successively convey the printing medium to the image transferring position on each of the image carriers, fixing means located downstream of the printing medium conveying means to fix the unfixed toner image on the printing medium, endless driving power transmitting means for concurrently transmitting driving power to the image carriers, the printing medium conveying means and the fixing means, and driving power source for driving the driving power transmitting means.

Preferably, a wire is employed as driving power transmitting means. Alternatively, an endless belt with a number of gear teeth formed thereon may be employed. Each of the image carriers and printing medium conveying means are driven with the aid of common driving power transmitting means as mentioned above.

Other objects, features and advantages of the present invention will become more clearly apparent from reading of the following description which has been prepared in conjunction with the accompanying drawings.

BRIEF DESCRIPTION OF THE DRAWINGS

The accompanying drawings will be briefly described below.

DETAILED DESCRIPTION OF THE PREFERRED EMBODIMENTS

Now, the present invention will be described in a greater detail hereunder with reference to the accompanying drawings which illustrate preferred embodiments thereof.

Figure 7:
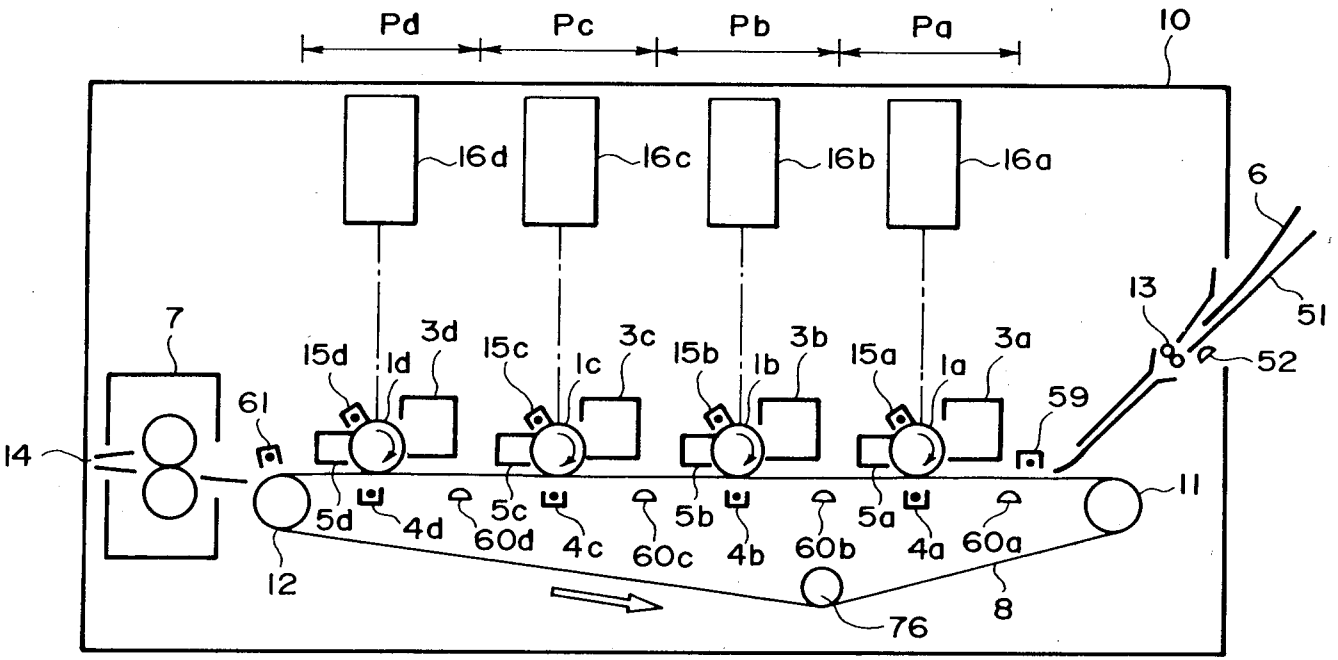
FIG. 7 is a schematic side view of a color printer to which the invention is applied.

FIG. 7 is a sectional side view of a color printer to which an embodiment of the invention is applied. In the illustrated embodiment the color printer has four sets of electrographic laser beam printing mechanisms incorporated therein as an image forming section. In the drawing reference numeral 10 designates a casing of the printer and reference characters Pa, Pb, Pc and Pd designate four sets of image forming sections which are arranged one after another from the right-hand side to the left-hand side of the casing 10 as seen in the drawing. Reference numeral 11 designates a driving roller for driving an endless conveyor belt. The driving roller 11 is adapted to be rotated with the aid of driving power source which is not shown in the drawing. As is apparent from the drawing, the conveyor belt 8 is extended around the driving roller 11 of which outer surface is lined with insulation mesh film made of polyester mesh, polyvinyl chloride film or the like so as to constitute a printing medium supporting portion. Specifically, the conveyor belt 8 is constituted with the use of mesh structure made of Teflon polyester fiber and it is caused to circulate in the direction as identified by an arrow mark in the drawing as the driving roller 11 is rotated. Reference numeral 13 designates a paper feeding mechanism which is disposed at the right-hand side of the casing, reference numeral 7 designates an image fixing device which is disposed at the left end part of the casing and reference numeral 14 designates an outlet port through which printing medium is discharged from the printer.

The image forming sections Pa, Pb, Pc and Pd are identical to one another in structure and function. Specifically, the image forming sections Pa, Pb, Pc and Pd include photosensitive drums 1*a*, 1*b*, 1*c* and 1*d* adapted to be rotated about their axes in the direction as identified by arrow marks, the photosensitive drums 1*a*, 1*b*, 1*c* and 1*d* serving as image carrier respectively, electric charging devices 15*a*, 15*b*, 15*c* and 15*d* disposed adjacent to the circumferences of the drums, developing devices 3*a*, 3*b*, 3*c* and 3*d* also disposed adjacent to the circumferences of the drums, electric discharging devices, 4*a*, 4*b*, 4*c* and 4*d* also disposed adjacent to the circumferences of the drums, cleaning devices 5*a*, 5*b*, 5*c* and 5*d* also disposed adjacent to the circumferences of the drums and laser beam scanners 16*a*, 16*b*, 16*c* and 16*d* disposed above the drums. It should be noted that the charging devices 15*a*, 15*b*, 15*c* and 15*d*. the developing devices 3*a*, 3*b*, 3*c* and 3*d*, the discharging devices 4*a*, 4*b*, 4*c* and 4*d* and the cleaning devices 5*a*, 5*b*, 5*c* and 5*d* are arranged one after another in accordance with the order as identified by the direction of rotation of the drums. Each of the laser beam scanners comprises semiconductor laser, polygon mirror, f$\theta$ lens and others and they function in such a manner that when they receive input in the form of electrical digital image signal, laser beam which is modulated in response to thus received image signal is emitted toward the area as defined between the charging devices 15*a*, 15*b*, 15*c* and 15*d* and the developing devices 3*a*, 3*b*, 3*c* and 3*d* to scan the drum in the longitudinal direction of the latter. Thus, each of the drums is subjected to exposure in that way.

Further, the developing device 3*a* in the first image building section Pa contains toner having yellow color, the developing device 3*b* in the second image forming section Pb contains toner having magenta color, the developing device 3*c* in the third image forming section Pc contains toner having cyan color and the developing device 3*d* in the fourth image forming section Pd contains toner having black color. Thus, the laser beam scanner 16*a* in the first image forming section Pa is supplied with an image signal corresponding to yellow component image, the laser beam scanner 16*b* in the second image forming section Pb is supplied with an image signal corresponding to magenta component image, the laser beam scanner 16*c* in the third image forming section Pc is supplied with an image signal corresponding to cyan component image and the laser beam scanner 16*d* in the fourth image forming section Pd is supplied an image signal corresponding to image signal corresponding to black component image.

In the illustrated embodiment cut sheet-shaped printing paper is used as printing medium. When the printing paper 6 is placed on a paper feeding guide 51 of the paper feeding mechanism 13, its foremost end is detected by means of a sensor 52. Thereafter, start signal is generated by the sensor 52 and the photosensitive drums 1*a*, 1*b*, 1*c* and 1*d* in the image forming sections Pa, Pb, Pc and Pd start their rotation in response to thus generated start signal. At the same time the driving roller 11 starts its rotation and the conveyor belt 8 also start its circulation in the direction as identified by arrow mark. After the printing paper 6 leaves the paper feeding guide 51, it is delivered onto the conveyor belt 8. At this moment the printing paper 6 is subjected to corona discharging under the effect of an electric charging device 59 whereby it is firmly attached to the conveyor belt 8.

When sensors 60*a*, 60*b*, 60*c* and 60*d* are successively shut by the foremost end of the moving printing paper 6, a signal is generated by them and in response to the thus generated signal image building is successively initiated on the photosensitive drums 1*a*, 1*b*, 1*c* and 1*d* in the image forming sections Pa, Pb, Pc and Pd each of which is previously kept in the rotated state. Specifically a yellow toner image is formed on the photosensitive drum 1*a* in the first image forming section Pa, a magenta toner image is formed on the photosensitive, drum 1*b* in the second image forming section Pb, a cyan toner image is formed on the photosensitive drum 1*c* in the third image forming section Pc and a black toner image is then formed on the photosensitive drum 1*d* in the fourth image forming section Pd.

Image forming in each of the image forming sections is achieved in accordance with the principle of Carlson process but description on the latter will not be required. As the conveyor belt 8 is circulated in that way, the printing paper 6 is displaced toward the fixing device 7 successively through the first to fourth image forming sections Pa to Pd until a required color image is completed by superimposing all toner images on the printing paper 6 one above another with the aid of the discharging devices 4*a* to 4*d*. After the printing paper 6 moves past the fourth image forming section Pd, it is free from electricity under the effect of an electricity removing device 61 having AC voltage applied thereto and thereafter it is parted away from the conveyor belt 8. Then, the printing paper 6 is introduced into the fixing device 7 in which the unfixed toner image is subjected to fixing and after completion of fixing it is discharged from the printer through the outlet port 14. Thus, one printing cycle is completed.

Next, a description will be made below as to how the conveyor belt 8 and the photosensitive drums are driven in operative association with one another with the use of a wire in accordance with the present invention. Incidentally, to facilitate understanding of the present invention description will be made with reference to FIG. 3 which schematically illustrates a combination of the driving roller 11, the driven roller 12 and the four photosensitive drums 1*a*, 1*b*, 1*c* and 1*d* and moreover illustrates by way of a perspective view how a driving wire 70 is utilized as well as FIG. 4 which also schematically illustrates the same by way of a plan view.

Figure 3:
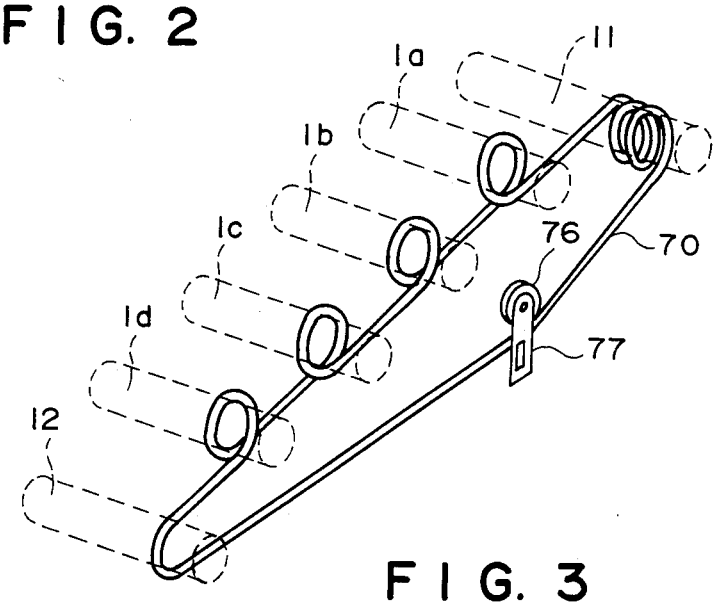
FIG. 3 is a schematic perspective view of an apparatus in accordance with other embodiment of the invention.
Figure 4:
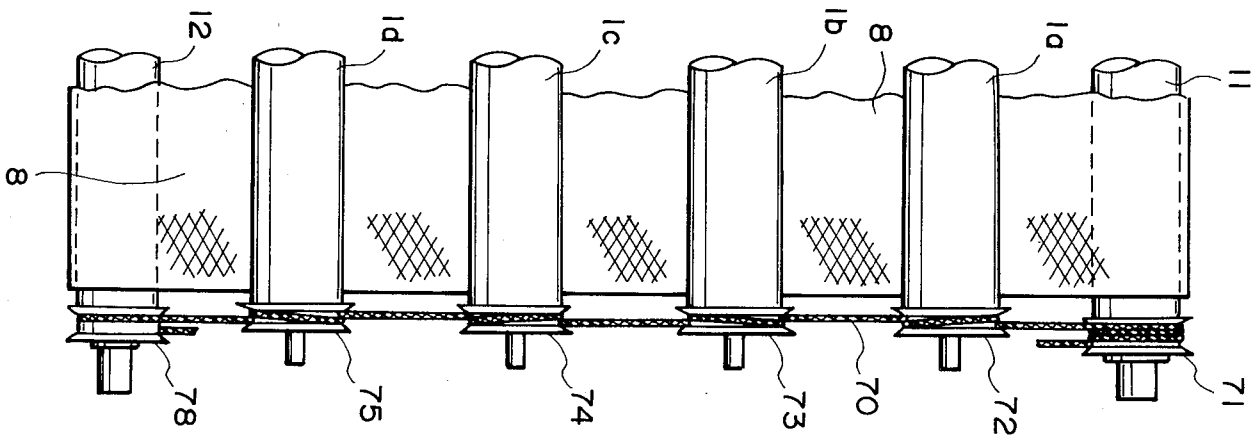
FIG. 4 is a fragmental plan view of the apparatus in FIG. 3.

Referring to FIG. 4, the driving wire 70 is wound around a pulley 71 which is fixedly mounted on the right end part of the driving roller 11 as seen in the drawing. The pulley 71 is dimensioned to have the same radius as that of a contact circle along which the conveyor belt 8 comes in contact with the driving roller 11. In the illustrated embodiment it is made integral with the driving roller 11. As shown in FIG. 4, the driving wire 71 is wound around the pulley 71 by three turns in order to assure increased driving force. After leaving the pulley 71, the driving wire 70 reaches a pulley 72 which is fixedly mounted on the right end part of the first photosensitive drum 1*a*. The contact surface of the pulley 72 is so designed that the latter has the same radius as that of the photosensitive drum 1*a* in the same manner as the pulley 71 for the driving roller 11. The manner of winding the driving wire 70 around the pulley 72 is as illustrated in FIGS. 3 and 4. In the illustrated embodiment the driving wire 70 is wound around the pulley 72 by single turn. However, the present invention should not be limited only to this. Alternatively, it may be wound by two or three turns in the case where a high intensity of drum driving torque is required or slippage is likely to take place.

Winding of the driving wire 70 around pulleys 73, 74 and 75 is achieved for the other three photosensitive drums 1*b*, 1*c* and 1*d* in the above-described manner. Finally, the driving wire 70 is brought back to the pulley 71 via a pulley 78 which is fixedly mounted on the right end part of the driven roller 12. A tension roller 76 as shown in FIG. 3 is intended to impart a predetermined intensity of tension to the driving wire 70. In view of increased durability and frictional force, it is preferable that the driving wire 70 is made of stainless steel and its surface is coated with nylon or the like resin. Further, in the illustrated embodiment a single line of driving wire is wound around the one end parts of the driving roller, the photosensitive drums and the driven roller but the present invention should not be limited only to this. Alternatively, two lines of driving wires may be wound around both the end parts of them. It has been confirmed that when the last-mentioned embodiment of the invention is employed, remarkable reduction of slippage between the conveyor and the photosensitive drums and increase in driving force are achieved.

Figure 5:
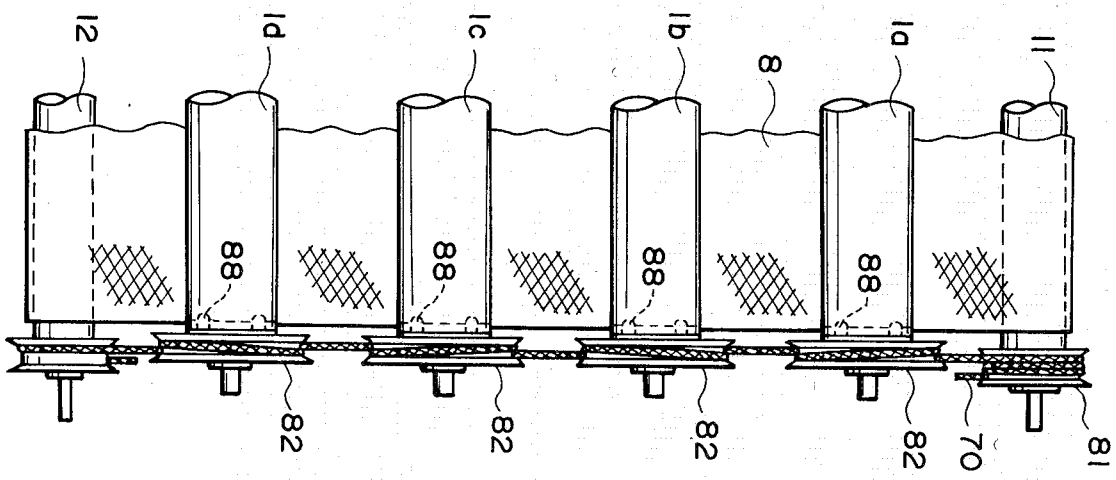
FIG. 5 is a fragmental plan view similar to FIG. 4, illustrating an apparatus in accordance with another embodiment of the invention.
Figure 6:
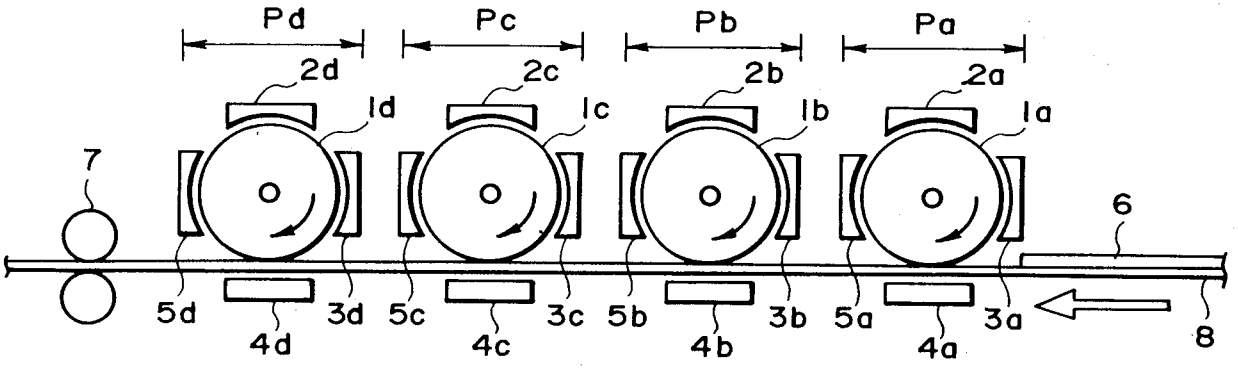
FIG. 6 PRIOR ART
FIG. 6 is a fragmental side view of a conventional color printer.

FIG. 5 is a plan view of an apparatus in accordance with other embodiment of the invention, as seen from the above in the same manner as in FIG. 4. As will be apparent from the drawing, a pulley 81 for the driving roller and a plurality of pulleys 82 for the photosensitive drums are so designed that they have a diameter larger than that in the foregoing embodiment. This is intended to assure increased driving force and increased contact length between the driving wire and each of the pulleys by allowing the latter to have a diameter larger than that of the driving roller and the photosensitive drums. This leads to a result that an occurrence of slippage between the driving wire and the pulleys is inhibited. Even when it is assumed that a very small amount of slippage takes place between the driving wire and each of the pulleys, it is reduced by a ratio of enlargement of the pulleys in that way as seen on an actually produced image and therefore it becomes possible to reduce image deviation as far as possible. In this embodiment a diameter of each of the pulleys is enlarged by about one and half times compared with the foregoing embodiment.

To assure that the existent photosensitive drums are easily replaced with new ones a plurality of detachable type coupling mechanisms 88 may be disposed between drums and pulleys instead of the integral structure having pulleys and photosensitive drums made integral with one another. In this case the pulleys are detachably fitted to the photosensitive drums with the aid of the coupling mechanisms 88 whereby the drums are rotated by means of the driving wire and the pulleys via the coupling mechanisms 88. Replacement or removal of the photosensitive drums and other components can be carried out only after the couplings mechanisms 88 are detached.

Figure 1:
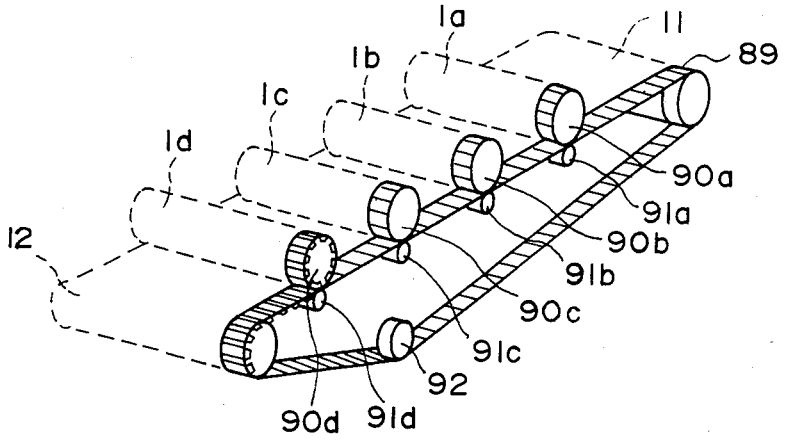
FIG. 1 is a perspective view of an apparatus in accordance with an embodiment of the invention.

FIG. 1 is a schematic perspective view of an apparatus in accordance with another embodiment of the invention where an endless geared belt is employed in place of the driving wire as shown in FIGS. 3 and 5.

As long as the upper surface of the conveyor belt is located in horizontal alignment with the pitch line of the geared belt 89, the latter is caused to move at the same speed as moving speed of the conveyor belt. Further, when a pulley having a pitch circle of which diameter is determined same to that of the photosensitive drum 1*a* is operatively connected to the latter via a coupling or the like means which is not shown in the drawing, moving speed of the conveyor belt becomes identical to the circumferential speed of the photosensitive drum 1*a*. In the drawing, reference numeral 91 designates a backup pulley and reference numeral 92 designates a tensioner.

Figure 2:
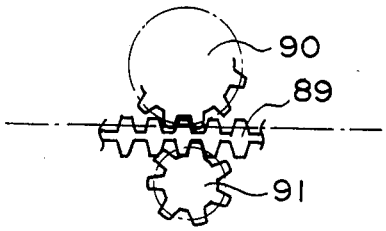
FIG. 2 is a fragmental front view of the apparatus, particularly illustrating a driving system for photosensitive drums.

As shown in more details in FIG. 2, the backup pulley 91 is designed in the form of a geared pulley but the present invention should not be limited only to this. Any type of backup pulley may be employed, when it is proven that it properly functions in the same manner as the geared pulley.

The illustrated embodiment has been described above with respect to the case where an endless geared belt is used but the present invention should not be limited only to this. Alternatively, the geared belt may be replaced with a combination of gears and endless chain. Since driving force transmitting means such as a geared belt or the like is made integral with the conveyor belt, it is possible to improve accuracy of conveying speed. Further, in the above-described embodiment the endless belt 8 is driven merely by means of a single roller 11. However, the present invention should not be limited only to this. Alternatively, a plurality of rollers each of which serves as a driving roller may be employed for carrying out the present invention.

The present invention has been described above with respect to the embodiments where a plurality of photosensitive drums are used as image carrier and a latent image is formed on each of the photosensitive drums by electrical charging and subsequent exposure. However, there is already known another technical concept that an ion beam is modulated in the image-shaped pattern to form a latent image on an electric insulation drum or a toner image is formed on such an electric insulation drum without any necessity for forming a latent image thereon. The above-mentioned technical concept is applicable to the present invention for carrying out the latter.

Further, the image carrier should not be limited only to a drum. Alternatively, it may be designed in the form of a belt or the like. Further, conveying means should not be limited only to such a type that printing medium is supported on a belt. Alternatively, an endless belt of the type including a gripper adapted to grip the foremost end of printing medium may be employed.

Figure 8:
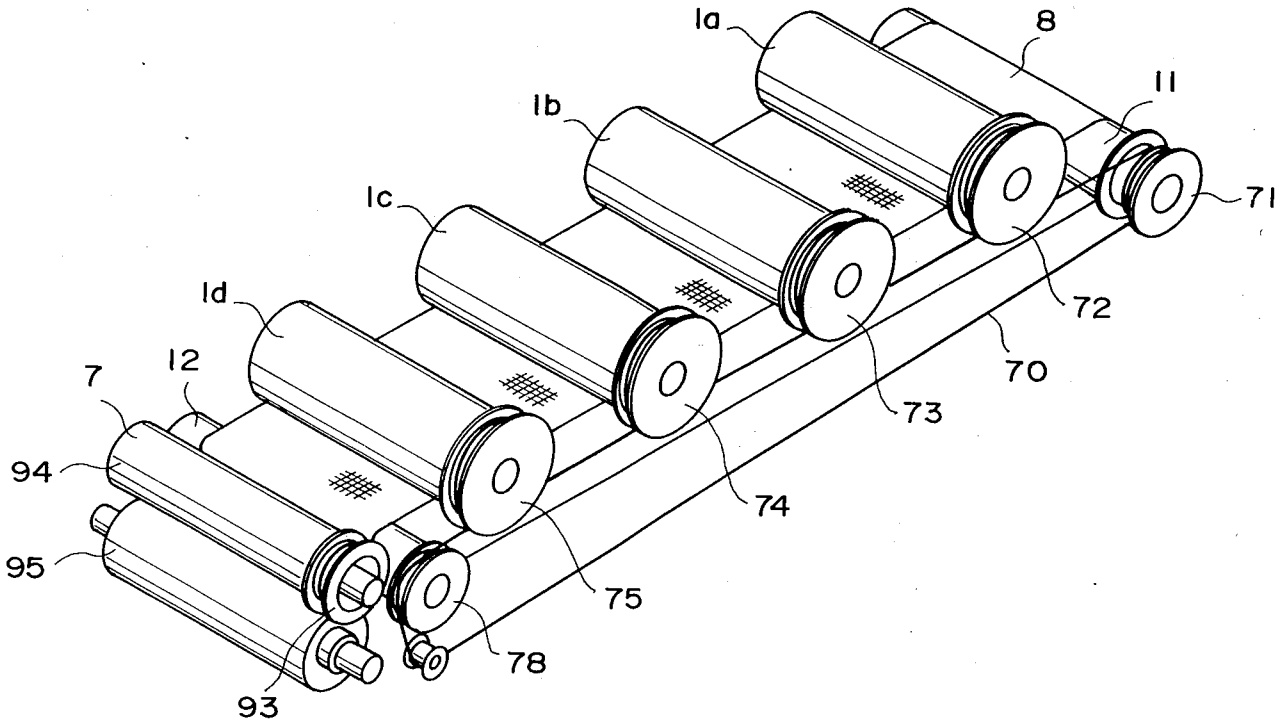
FIG. 8 is a perspective view of an apparatus in accordance with further another embodiment of the invention.

FIG. 8 is a schematic perspective view of an apparatus in accordance with further another embodiment of the invention. In the case where the fixing device 7 is equipped with a heating roller, a driving wire 70 is wound further around a pulley 93 which is fixedly mounted on the one end part of a roller 94 for the fixing device 7 whereby the latter is driven by means of the driving wire 70. This embodiment has advantageous features that the fixing device 7 requires no driving force source and moreover quality of image is not degraded any longer because both the rollers 94 and 95 are rotated at the same circumferential speed as conveying speed of the printing medium 6 and thereby unfixed toner image is not rubbed off by means of the roller 94 as is seen when it rotates at a certain different speed. Further, since the printing medium 6 and the rollers 94 and 95 are caused to operate at the same speed, the foremost end of the printing medium does not collide against the circumferential surface of either of the rollers and moreover there is no fear of causing image deviation.

Incidentally, some conventional apparatus is so constructed that circumferential speed of rollers disposed in the fixing device is determined appreciably less than conveying speed of printing medium and thereby the latter is conveyed in the flexed state. If necessary, the apparatus of the invention can be operated under the same operative condition as that of the above-mentioned conventional apparatus merely by determining a diameter of rollers in the fixing device larger than that of each of pulleys.

Also, in this case, a construction which has been described above with reference to FIG. 5 may be employed for carrying out the present invention.

As will be apparent from the above description, the apparatus of the invention assures very exact operative association between conveying means for printing medium and image carriers such as photosensitive drums or the like. Even when there occurs a very small amount of fluctuation in moving speed of conveying means, this fluctuation is transmitted directly onto the circumferential surface of each of the photosensitive drums, resulting in a plurality of color images being located in exact alignment one above another easily and stably.

Further, since driving for both conveying means and image carriers is achieved merely with the use of a single driving system, there is no necessity for separately providing a driving system for each of them as is seen with the conventional apparatus and therefore separately adjusting driving speed for both the driving systems. As a result, the apparatus of the invention can be constructed in smaller dimensions and simple structure.

While the present invention has been described above with respect to a few preferred embodiments thereof, it should of course be understood that it should not be limited only to them but various changes or modifications may be made in any acceptable manner without departure from the spirit and scope of the invention.

We claim:

1. A color image forming apparatus of the type in which a multi-color image is formed by successively transferring a plurality of different color toner images onto a printing medium one above another, comprising:

a plurality of rotatably supported image carriers including driving power receiving portions;

toner image forming means located opposite each of said image carriers for forming a color toner image on the latter;

image transferring means disposed at an image transferring position, where a toner image formed on each of said image carriers is transferred onto the printing medium;

printing medium conveying means for endlessly moving under the effect of driving power to successively convey the printing medium to the image transferring position for each of said image carriers; and driving means common to said plurality of image carriers and to said printing medium conveying means for providing driving power for said image carriers and said printing medium conveying means, respectively.

2. A color image forming apparatus according to claim 1, wherein said driving power transmitting means comprises a wire, and said image carriers and said printing medium conveying means are driven by driving force transmitted from said wire via a plurality of pulleys around which said wire is wound.

3. A color image forming apparatus according to claim 1, wherein said driving power transmitting means comprises an endless geared belt and said image carriers and said printing medium conveying means are driven by driving force transmitted from said geared belt via a plurality of gears which mesh with said geared belt.

4. A color image forming apparatus according to claim 3, wherein said geared belt is formed with a number of gear teeth on both the outside and inside thereof, and the gear teeth on the outside drive said image carriers while the gear teeth on the inside drive said printing medium conveying means.

5. A color image forming apparatus according to claim 2, wherein each said pulley is detachably fitted to one of said image carriers by a coupling mechanism interposed therebetween.

6. A color image forming apparatus according to claim 1, wherein each of said image carriers comprises a photosensitive body on which a latent image can be formed by electrical charging and scanning with a laser beam, whereby the thus-built latent image can be developed using toner.

7. A color image forming apparatus according to claim 2, wherein each of said pulleys has a diameter larger than that of a photosensitive drum which serves as a corresponding said image carrier.

8. A color image forming apparatus according to claim 7, wherein each of said pulleys has a diameter larger than that of plural support rollers for an endless belt member comprising said printing medium conveying means.

9. A color image forming apparatus according to claim 2, wherein each of said pulleys has a diameter larger than that of plural support rollers for an endless belt member comprising said printing medium conveying means.

10. A color image forming apparatus of the type in which a multi-color image is formed by successively transferring a plurality of different color toner images onto a printing medium one above another, comprising:

a plurality of rotatably supported image carriers including driving power receiving portions;

toner image forming means located opposite each of said image carriers for forming a color image on the latter;

image transferring means disposed at an image transferring position, where a toner image formed on each of said image carriers is transferred onto the printing medium;

printing medium conveying means for endlessly moving under the effect of driving power to successively convey the printing medium to the image transferring position for each of said image carriers;

fixing means downstream of said printing medium conveying means for fixing the toner image transferred onto the printing medium under the effect of driving power; and driving means common to said plurality of image carriers, to said printing medium conveying means and to said fixing means for providing driving power for said image carriers, said printing medium conveying means and said fixing means, respectively.

11. A color image forming apparatus according to claim 10, wherein said driving power transmitting means comprises a wire, and said image carriers and said printing medium conveying means are driven by driving force transmitted from said wire via a plurality of pulleys around which said wire is wound 12. A color image forming apparatus according to claim 11, wherein each said pulley is detachably fitted to one of said image carriers by a coupling mechanism interposed therebetween.

13. A color image forming apparatus according to claim 1, wherein said driving means includes endlessly moving driving power transmitting means and a driving power source for driving said driving power transmitting means, wherein said driving power transmitting means is capable of acting on said plurality of image carriers and said printing medium conveying means to transmit driving power from said driving power source thereto.

14. A color image recording apparatus according to claim 1, wherein said image transferring means includes a corona discharger for each said image carrier.

15. A color image forming apparatus according to claim 10, wherein said driving means includes endlessly moving driving power transmitting means and a driving power source for driving said driving power transmitting means, wherein said driving power transmitting means is capable of acting on said plurality of image carriers, said printing medium conveying means and said fixing means to transmit driving power from said driving power source thereto.

16. A color image forming apparatus according to claim 10, wherein said fixing means includes a pair of rotary members for conveying the printing medium therebetween.

17. A color image forming apparatus according to claim 10, wherein said printing medium conveying means includes a belt-like member.

18. A color image forming apparatus according to claim 10, wherein said image transferring means includes a corona discharger for each said image carrier.

* * * * *

UNITED STATES PATENT AND TRADEMARK OFFICE

CERTIFICATE OF CORRECTION

PATENT NO. : 4,788,574

DATED : November 29, 1988

INVENTOR(S) : KENICHI MATSUMOTO, ET AL.

It is certified that error appears in the above-identified patent and that said Letters Patent is hereby corrected as shown below:

Cover Page,

[75] Inventors: "Kadowaki" should read --Hidejiro Kadowaki--.

Column 1, line 37, "5d" should read --5d,--;

line 38, "art" should read --art,--.

Column 2, line 43, "carrier" should read --carriers--;

line 56, "images" should read --images are applied--.

Column 3, line 28, "other" should read --another--;

line 40, "further" should read --yet--.

Column 4, line 17, "carrier" should read --carriers--;

line 35, "signal, laser" should read --signals, a laser--;

line 36, "to" should read --to a--;

lines 59-60, "image signal corresponding to" should be deleted.

Column 5, line 65, "wire 71" should read --wire 70--.

UNITED STATES PATENT AND TRADEMARK OFFICE

CERTIFICATE OF CORRECTION

PATENT NO. : 4,788,574

DATED : November 29, 1988

INVENTOR(S) : KENICHI MATSUMOTO, ET AL.

It is certified that error appears in the above-identified patent and that said Letters Patent is hereby corrected as shown below:

Column 6, line 37, "other" should read --another--;

line 58, "existent" should read --existant--.

Column 7, line 12, "determined" should read --the--; same line, "to" should read --as--.

Column 9, line 9, "claim 1" should read --claim 13--;

line 15, "claim 1" should read --claim 13--.

Column 10, line 19, "claim 10" should read --claim 15--.

Signed and Sealed this

Eighteenth Day of April, 1989

*Attest:*

*Attesting Officer*

DONALD J. QUIGG

*Commissioner of Patents and Trademarks*